US005398457A

United States Patent [19]

Updegrave et al.

[11] Patent Number: 5,398,457

[45] Date of Patent: Mar. 21, 1995

[54] EDGE AND CORNER SANDING ATTACHMENT

[76] Inventors: Scott A. Updegrave, 1272 Berrydale Dr., Petaluma, Calif. 94954; Allen M. Updegrave, 920 Wallace Ave., Chambersburg, Pa. 17201

[21] Appl. No.: 151,296

[22] Filed: Nov. 12, 1993

Related U.S. Application Data

[63] Continuation-in-part of Ser. No. 989,176, Dec. 11, 1992, abandoned, and a continuation-in-part of Ser. No. 65,865, May 21, 1993.

[51] Int. Cl.[6] ..... B24B 19/00; B24B 23/00

[52] U.S. Cl. ..... 451/415; 30/500; 451/344; 451/356

[58] Field of Search ..... 51/241 R, 170 TL, 170 R, 51/174, 180, 175, 170 T, 166 TS, 181 R; 30/122, 90, 500

[56] References Cited

U.S. PATENT DOCUMENTS

| | | | |
|---|---|---|---|
| 2,332,613 | 10/1943 | Swank | 51/170 TL |
| 2,350,098 | 5/1944 | Decker | 51/170 TL |
| 2,526,976 | 10/1950 | Smith | 51/170 TL |
| 2,734,139 | 2/1956 | Murphy | 51/170 TL |
| 3,079,842 | 3/1963 | Primich | 51/241 R |
| 4,091,579 | 5/1978 | Giangiulio | 51/181 R |
| 4,128,970 | 12/1978 | Sawrenko | 51/181 R |
| 4,423,571 | 1/1984 | Selander | 51/170 R |
| 4,768,310 | 9/1988 | Butts | 51/141 |
| 4,774,789 | 10/1988 | Amalfi | 51/170 TL |
| 4,802,310 | 2/1989 | Holmes | 51/170 MT |
| 4,829,719 | 5/1989 | Braselton | 51/170 TL |
| 4,893,437 | 1/1990 | Doherty | 51/170 TL |
| 4,920,702 | 5/1990 | Kloss | 51/170 R |
| 4,930,267 | 6/1990 | Hill | 51/180 |
| 5,022,189 | 6/1991 | Saul | 51/170 TL |
| 5,140,778 | 8/1992 | Carruth | 51/170 R |
| 5,170,589 | 12/1992 | Harinen | 51/241 B |
| 5,179,807 | 1/1993 | Gupton | 51/170 R |
| 5,205,079 | 4/1993 | Lashley | 51/170 TL |

FOREIGN PATENT DOCUMENTS

| | | | |
|---|---|---|---|
| 0333933 | 3/1988 | European Pat. Off. | 51/170 TL |
| 0562085 | 5/1973 | Switzerland | 51/170 T |

*Primary Examiner*—Bruce M. Kisliuk
*Assistant Examiner*—Bo Bounkong
*Attorney, Agent, or Firm*—Limbach & Limbach

[57] ABSTRACT

A removable mounting bracket with an extended sanding foot for attachment to a vibrating or orbital sander which mounts against the platen of a sander to allow for sanding of inside corners and edges.

11 Claims, 6 Drawing Sheets

EDGE AND CORNER SANDING ATTACHMENT

This is a continuation-in-part of application Ser. No. 07/989,176, filed on Dec. 11, 1992, now abandoned. This application is also a continuation-in-part of Ser. No. 08/065,865, filed May 21, 1993.

BACKGROUND

1. Field of Invention

This invention relates to sanders, specifically removable edge and corner sanding attachment adaptable to all vibrating or orbital type sanders.

2. Description of Prior Art

There are presently power tools which are specifically designed and dedicated to flush sanding into edges and corners where two or more edge and/or corner surfaces meet at an angle and are fastened together. However, these dedicated edge and corner power sanders are prohibitively expensive to most craftsman.

Research of patent records at Sunnyvale, Calif. was accomplished. Related prior art found is U.S. Pat. No. 5,022,189, a sander extension device. However, prior art differs from my invention as it is intended for sanding curved surfaces and said device is mounted onto sandpaper clamps. The following text will elaborate on my invention. Several tool and trade catalogs advertise edge and corner sanding attachments for hand grinders. These attachments require disassembly, with various tools, of portions of grinders before said attachments can be used. To restore grinders to original configuration, attachments must be removed, using various tools, and grinder must be reassembled to its original configuration. This is very time consuming and inconvenient and discourages the user from utilizing attachments. Also, attachments presently available will fit only certain configurations of grinders

OBJECTS AND ADVANTAGES

Accordingly, several objects and advantages of my invention are:

(a) To provide an edge and corner sanding attachment system that is universally adaptable to all configurations of said sanders.

(b) To provide an edge and corner sander attachment system which embodies quick disconnect and removal from said sanders and very easily and quickly restoring the sander to it's original function.

(c) To provide an edge and corner sanding attachment system which does not require any special tools to install or remove from said sanders.

(d) To provide an edge and corner sander attachment system which is inexpensive to manufacture and convenient to adapt to said sanders.

Further objects and advantages of my invention will become apparent from considerations of the drawings and ensuing description.

DESCRIPTION OF INVENTION

Figure 1:
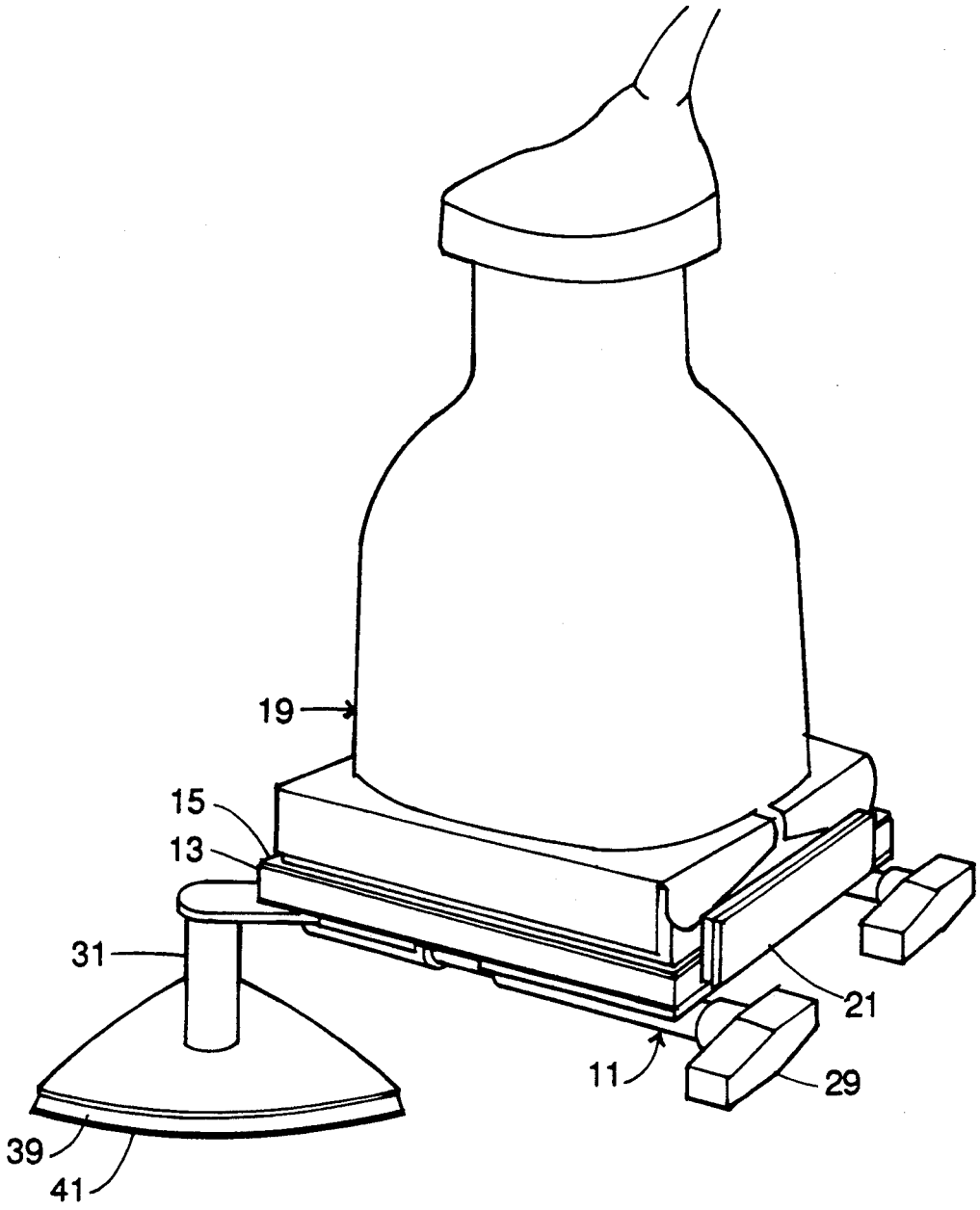
FIG. 1 is a view in perspective of clamp-on type sander attachment on a typical sander.
Figure 2:
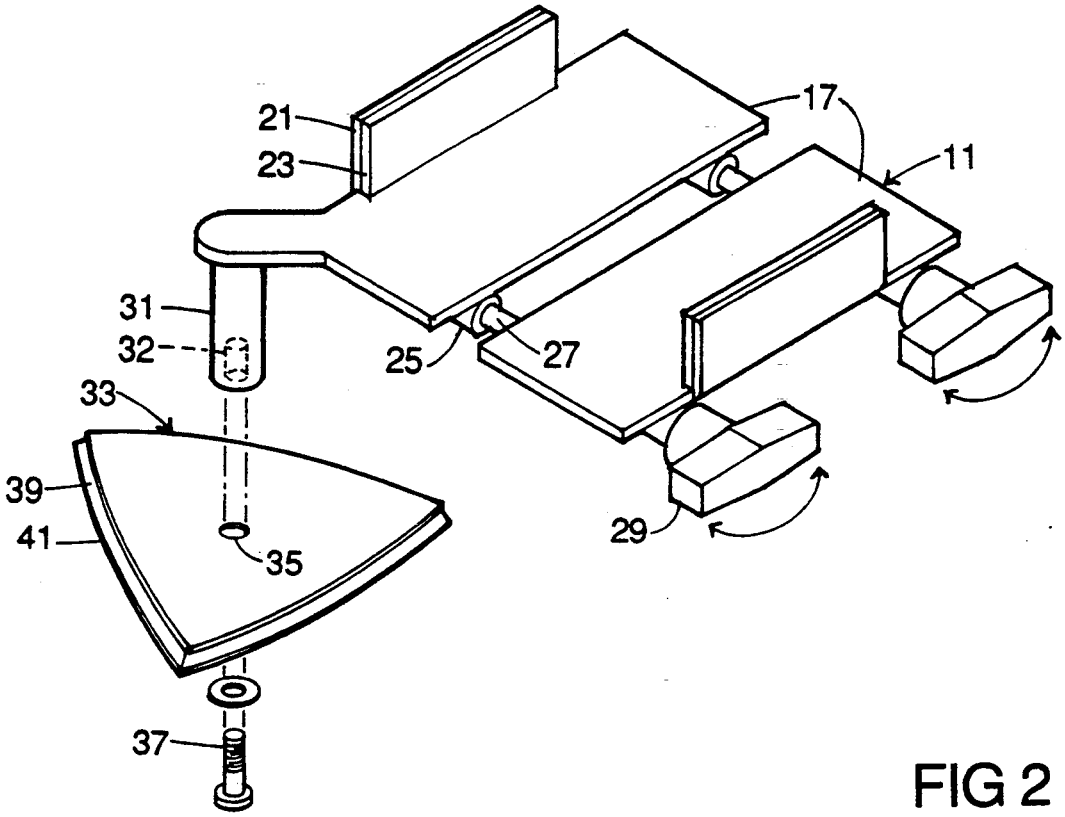
FIG. 2 is a view in perspective of disassembled clamp-on type sander attachment.
Figure 3:
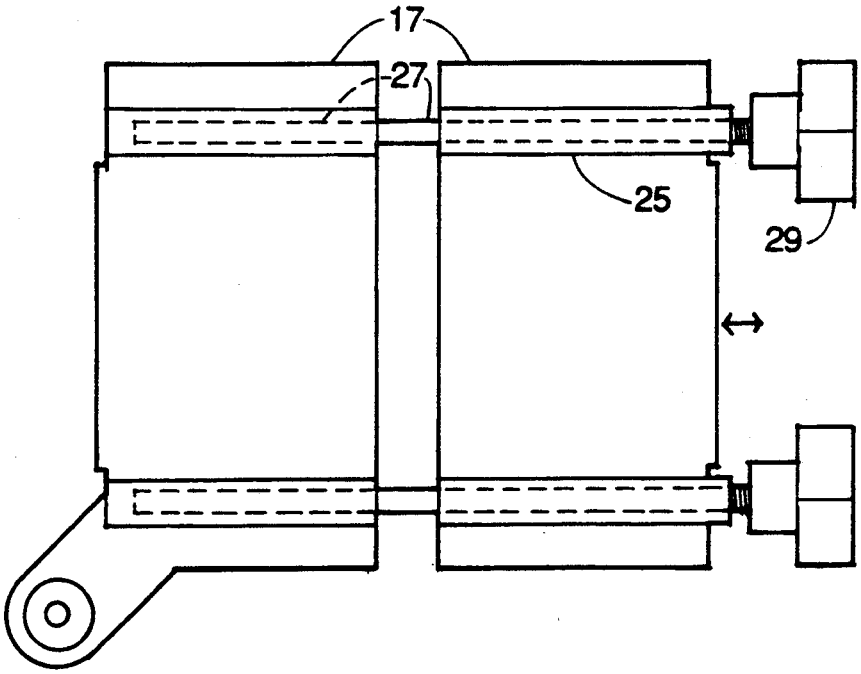
FIG. 3 is a bottom view of clamp-on type sander attachment.

As illustrated in FIGS. 1 to 3, my edge and corner sanding attachment invention is universally adaptable to all brands and types of vibrating and orbital sanders. Preferred embodiment sanding attachment is referred to as clamp-on type edge and corner sanding attachment. Clamp-on type attachment 11 is comprised of two halves. Clamp-on type attachment 11 mounts directly against edges of back-up plate and pad 13 and platen 15 of sander. Its trombone-like features permits adjustment plates 17 to accommodate different sizes of platens 15 and back-up plate and pad 13 of vibratory sander 19. Preferably, clamp-on type attachment 11 is made of metal or other types of material that demonstrate minimal distortion or bending when subjected to all of the physical requirements of subject sanding attachment. This includes the vibrating stresses transmitted to clamp-on type attachment 11 from platen 15 with ranges of ten to twenty five thousand vibrating oscillations per minute under continuous sanding operation. Plates 17 have tabs 21 bent or formed at 90 degree angles to plates 17. Tab pads 23 are affixed to tabs 21. Tab pads 23 are made of a hard but resilient material which, after assembly of complete clamp-on type attachment 11 to platen 15, fit tightly against platen 15 and absorb maximum vibrating oscillations from vibratory sander 19. Plate rod tubes 25 FIG.3 are fastened to the underside of each half of plates 17. Plate rods 27 are of an optimum length which will permit plates 17 and plate rod tubes 25 to be moved, in a trombone sliding action, to fit dimensions of platen 15 and back-up plate and pad 13 of any vibratory sander 19. Plate rods 27 are permanently fastened on one (1) tabbed edge of plate 17. Other ends of plate rods 27 are threaded to accept plate adjusting knobs 29 which have lock tight features. A finger-like extension extends outwardly from a corner of plate 17 a sufficient distance to allow adequate clearance between vibratory sander 19 and edges and corners to be sanded. Sanding foot rod 31 is permanently attached to this finger-like extension. One end of sanding foot rod 31 is permanently attached to the finger-like extension of plate 17. Other end of sanding foot rod 31 has a tapped and threaded screw hole 32. Preferred arced triangular sanding foot 33 has slightly arced edges and preferably made of metal of sufficient thickness to resist excessive bending. Subject arced triangular sanding foot 33 has a center hole 35 through which machine screw 37 fastens arced triangular sanding foot 33 to tapped and threaded screw hole 32 in sanding foot rod 31. Sanding foot pad 39 is permanently attached to bottom of arced triangular sanding foot 33. A pressure sensitive abrasive sheet 41 (sandpaper) with pressure sensitive releasably adhering features on its back, is attached to sanding foot pad 39.

Figure 4:
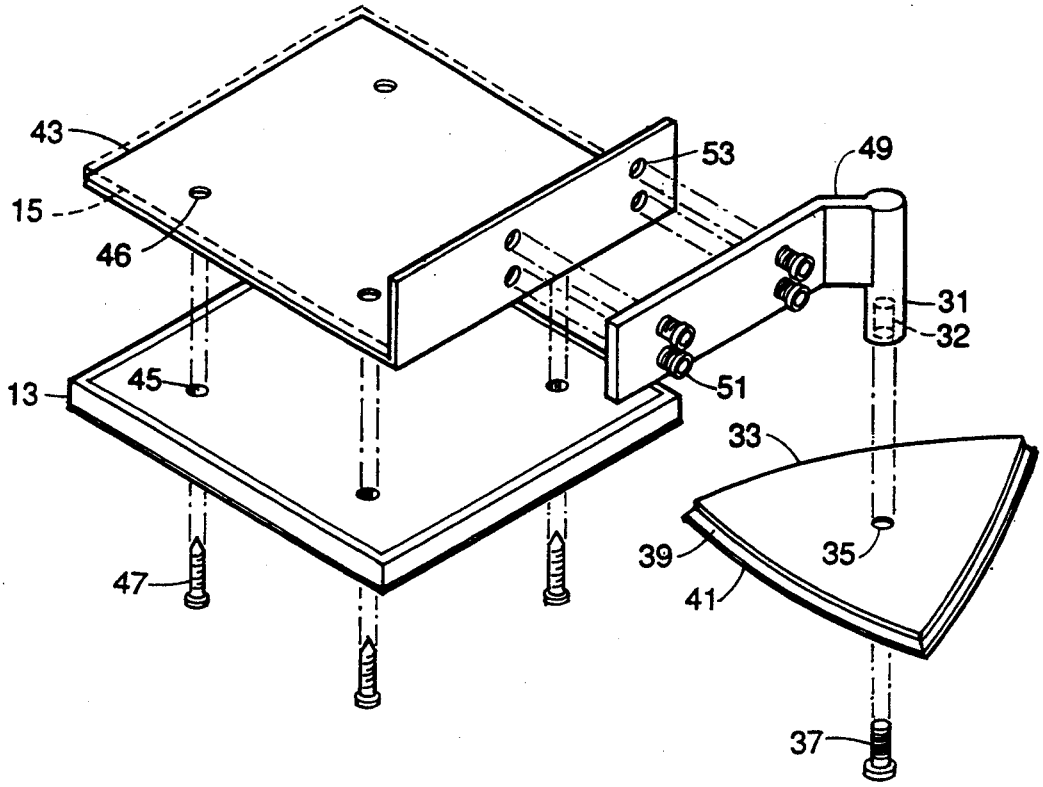
FIG.4 is a view in perspective of a disassembled sandwich plate type sander attachment embodiment.

FIG.4 illustrates another embodiment of the preferred edge and corner sanding system which utilizes a sandwich plate 43. Subject sandwich plate embodiment FIG. 4 is preferably made of a rigid material, such as metal, to minimize distortion and to maximize transmission of sander vibrating oscillations from platen 15. The end of sandwich plate 43 which contains the four threaded holes 53 is bent perpendicular to the surface fastened to platen 15. The four pad and platen fastening holes 45 in sandwich plate 43 align with the holes on platen 15 and back-up plate and pad 13 which allow back-up plate and pad 13 and sandwich plate 43 to be fastened to platen 15 by means of platen retaining screws 47. Sanding foot bracket 49 fastens to sandwich plate 43 with four sanding foot bracket retaining screws 51 into threaded holes 53. Sanding foot bracket 49 extends outwardly at an angle to which sanding foot rod 31 is permanently attached. Sanding foot rod 31 has a tapped and threaded screw hole 32. Preferred arced triangular sanding foot 33 has slightly arced edges and preferably made of metal of sufficient thickness to resist excessive bending. Subject arced triangular sanding foot 33 has a center hole 35 through which machine screw 37 fastens arced triangular sanding foot 33 to tapped and threaded screw hole 32 in sanding foot rod 31. Sanding foot pad 39 is permanently attached to bottom of arced triangular sanding foot 33. A pressure sensitive abrasive sheet 41 (sandpaper) with pressure sensitive releasably adhering features on its back, is attached to sanding foot pad 39.

Figure 5:
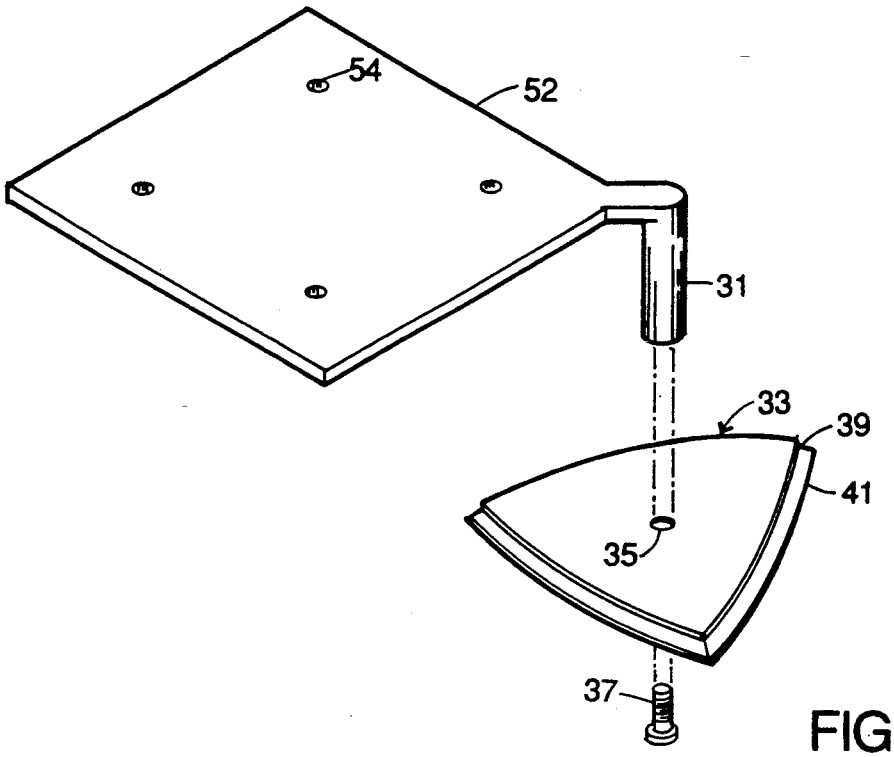
FIG. 5 is a view in perspective of a plate type embodiment of a sander attachment.

FIG. 5 shows a plate 52 embodiment of the preferred edge and corner sanding system. Plate holes 54 align with pad and platen fastening holes 45 as illustrated in FIG. 4. Sanding foot rod 31, and all components thereof, are the same as all components of sanding foot rod 31 FIG. 4 and those in FIG. 6 which are also described in description of preferred and other embodiments.

Figure 6:
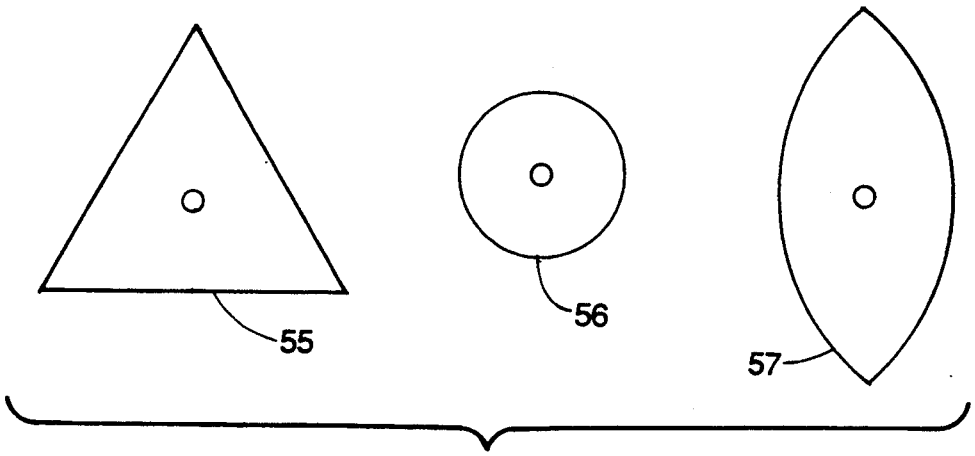
FIG. 6 is a top view of some typical alternate sanding foot shapes.

FIG. 6 illustrates alternate triangle sanding foot 55, circular sanding foot 56 and elliptical sanding foot 57. Sanding foot pad 39 in FIG. 2 is attached to bottom of typical alternate sanding foot shapes in FIG. 6. A pressure sensitive abrasive sheet 41 (sandpaper) with pressure sensitive releasably adhering features on its back, is attached to sanding foot pad 39. Alternate sanding foot shapes in FIG. 6 are fastened to sanding foot rod 31 as illustrated at FIGS. 2 and 4. The alternate sanding foot shapes indicated above are only a few of many possible geometrical shapes.

Figure 7:
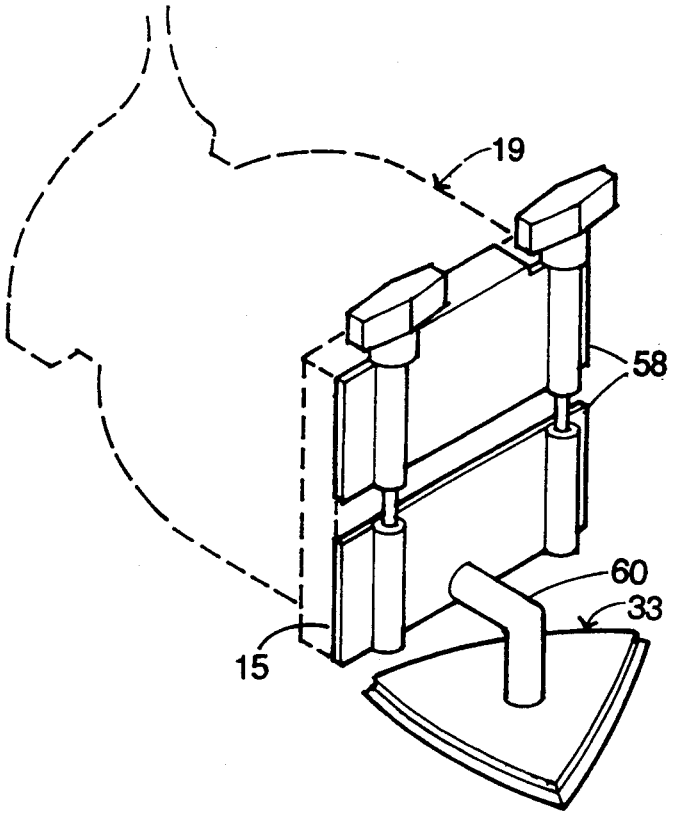
FIG. 7 is a view in perspective of an alternate embodiment of a clamp-on type sander attachment wherein the sanding foot is oriented in a plane perpendicular to the planten of the sander.
Figure 8:
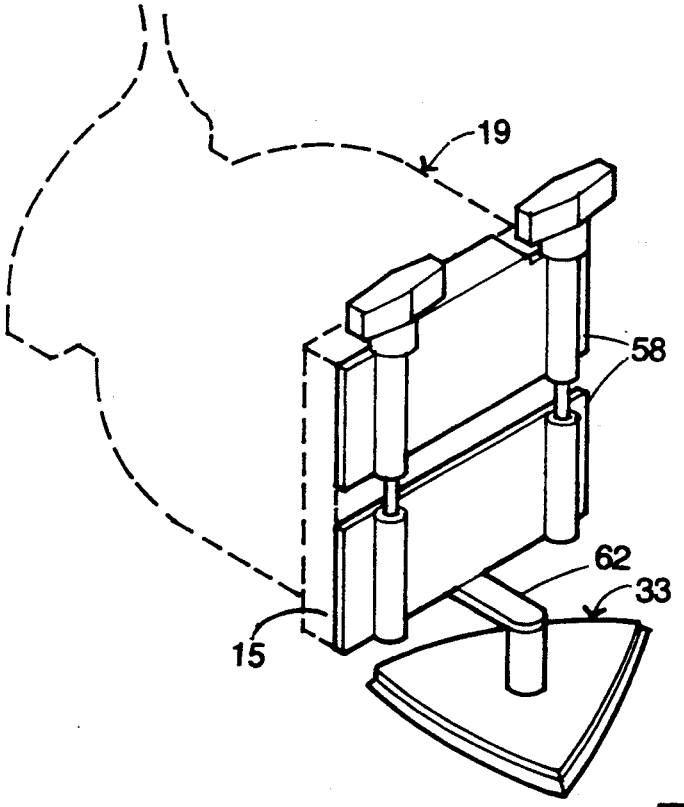
FIG. 8 is a view in perspective of still another alternate embodiment wherein the sanding foot is oriented in a plane perpendicular to the platen of the sander.

FIGS. 7 and 8 illustrate two alternate embodiments wherein the sanding foot 33 is oriented in a plane that is not parallel to the plane of the platen 15 of the sander. Preferably, the plane of the foot 33 is perpendicular to the plane of the platen 15. In addition, the foot is located beyond the perimeter of the platen. As seen in FIG. 7, the sanding foot 33 is mounted to plates 58 via extension member 60. Extension member 60 is L-shaped in configuration and is connected to the center of one of the plates 58. Alternatively, and as shown in FIG. 8, an extension member 62 can be attached to the side of plate 58. Arced triangular sanding foot 33 fastens to the sanding foot extensions 60, 62 in the same manner as that described for the preferred clamp-on type attachment 11 shown in FIG. 2.

Figure 9:
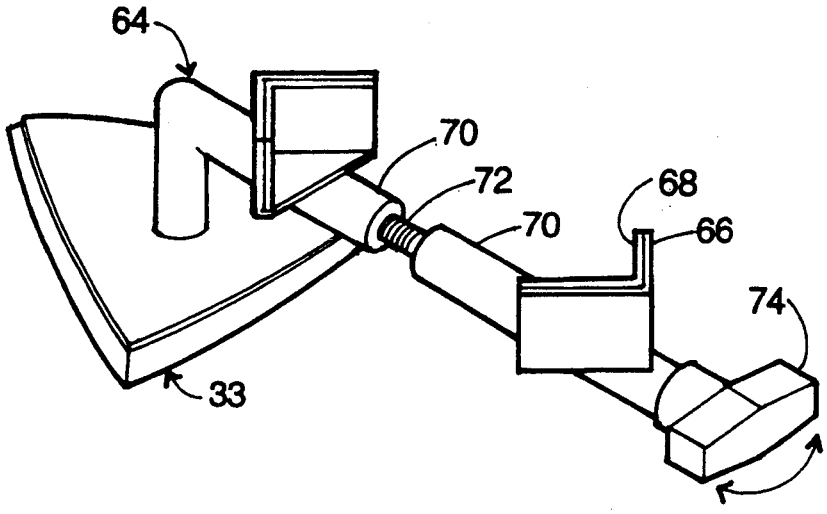
FIG. 9 is a view in perspective of still another alternate embodiment wherein the attachment is clamped to the corners of the platen of the sander.
Figure 10:
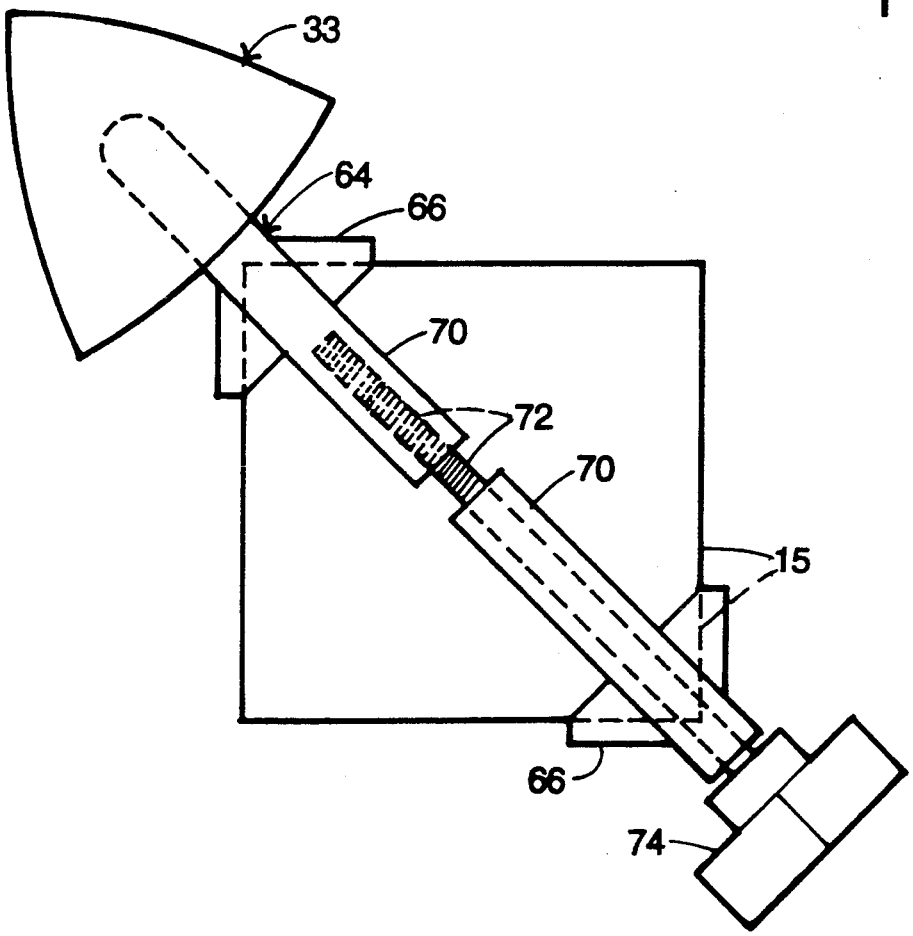
FIG. 10 is a bottom view of the corner clamp-on type attachment shown in FIG. 9.

FIGS. 9 and 10 illustrate a corner clamp-on type attachment 64 embodiment which is clamped to two corners of platen 15 by means of upstanding corner tabs 66. Corner tabs 66 have a right angle configuration. Corner tab pads 68 are connected to corner tabs 66 and are made of a hard but resilient material. When assembled, the corner tabs 66 and corner tab pads 68 fit tightly against platen 15 and absorb maximum vibrating oscillations from vibratory sander. Corner clamp tubes 70 are fastened to the underside of each corner tab 66. Corner clamp threaded rod 72 and corner clamp tube 70 are of an optimum length which will permit corner tabs 66 and corner clamp tube 70 to be adjusted inwardly or outwardly on corner clamp threaded rod 72. Corner clamp tube 70 is comprised of two halves. One end of corner clamp tube 70 is L-shaped to which arced triangular sanding foot 33 is fastened in the same manner as described for the preferred clamp-on type attachment 11 shown in FIG. 2. Corner clamp adjusting knob 74 is permanently affixed to one end of corner clamp threaded rod 72. The other end of corner clamp threaded rod 72 is threaded and screwed into one end of corner clamp tube 70.

OPERATIONS

Oscillating vibrations from a vibratory sander 19, typically illustrated in FIG. 1 are transmitted through the component parts of my invention to the sanding foot rod 31 of the preferred and all subsequently discussed embodiments. This causes the preferred arced triangular sanding foot 33 to oscillate thereby resulting in a sanding action. This resultant sanding action is transmitted to both the preferred and all subsequently discussed embodiments.

The preferred clamp-on type attachment 11 is shown installed on a vibratory sander 19 in FIGS. 1, 2 and 3 illustrate the clamp-on type attachment sanding system in exploded view and bottom view respectively. My invention is adaptable to any typical vibratory sander 19 as illustrated in FIG. 1. The primary and unique feature of clamp-on type attachment 11 that enables this versatility, is the ability of plates 17 to slide easily either together or apart on plate rods 27. This enables tabs 21 and tab pads 23 and 2, which clamp against platen 15 and back-up plate and pad 13, to adapt to any size vibratory sander 19. Clamp-on type attachment 11 is installed on a vibratory sander 19 by sliding plates 17 inwardly or outwardly so that the two halves are positioned against the back-up plate and pad 13 and then further sliding the two halves of plates 17 together until the tab pads 23 press snugly against the back-up plate and pad 13. Plate adjusting knobs 29 are then tightened until tab pads 23 are firmly compressed against back-up plate and pad 13 and platen 15. Machine screw 37 is inserted through center hole 35 of preferred arced triangular sanding foot 33 and screwed into the tapped and threaded screw hole 32 in sanding foot rod 31. Self adhesive abrasive sheet 41 is then pressed against sanding foot pad 39. The installation of preferred clamp-on type attachment 11 on said sander is now complete and ready to sand edges and corners.

The remaining paragraphs of "Operation" section discuss other significant embodiments and ramifications of the preferred edge and corner sanding attachment.

Reference FIG. 4, The sandwich plate embodiment is essentially comprised of a sandwich plate 43 and a sanding foot bracket 49. To assemble this sandwich plate embodiment to a sander, the back-up plate and pad 13 of vibratory sander 19 is removed by removing platen retaining screws 47 which fasten back-up plate and pad 13 to platen 15. Sandwich plate 43 is then positioned onto platen 15 by aligning the pad and platen fastening holes 45 with the sandwich plate fastening holes 46 in sandwich plate 43 with the holes in platen 15. Back-up plate and pad 13 is then positioned over sandwich plate 43. The holes in back-up plate and pad 13 are then aligned with those of sandwich plate 43 and platen 15. Sandwich plate retaining screws 47 are then inserted through the pad and platen fastening holes 45 in back-up plate and pad 13 and sandwich plate fastening holes 46 in sandwich plate 43 into platen 15 and firmly tightened. Sandwich plate 43 is now permanenty installed and does not have to be removed from a sander whether or not the sander is used for edge and corner sanding. Sanding foot bracket 49 is now attached to sandwich plate 43. The holes in sanding foot bracket 49 are aligned with the threaded holes 53. The four sanding foot bracket retaining screws 51 are inserted through the holes in sanding foot bracket 49 and screwed into the threaded holes 53 and firmly tightened. Machine screw 37 is then inserted through center hole 35 of preferred arced triangular sanding foot 33 and screwed into the tapped and threaded screw hole 32 in sanding foot rod 31. Self adhesive abrasive sheet 41 is then pressed against sanding foot pad 39. The installation of sandwich plate 43 type embodiment sanding attachment system on the sander is now complete and ready to sand edges and corners. After edge and corner sanding has been completed, sanding foot bracket 49 is removed from sandwich plate 43 by removing the four sanding foot bracket retaining screws 51.

Use of the plate 52 embodiment shown in FIG. 5 first requires removal of back-up plate and pad 13 as outlined in FIG. 4. The plate 52 and remaining components in FIG. 5 are then installed as previously described for sandwich plate 43 type sander. To restore said sander to its original configuration, the total embodiment must be removed and back-up plate and pad 13 reinstalled.

FIG. 6 shows top views of alternate embodiments of the preferred arced triangular sanding foot 33 shown in FIG. 2 and FIG.6 embodiments are in the forms of a triangle sanding foot 55, circular sanding foot 56 and an elliptical sanding foot 57. They are interchangeable with preferred arced triangular sanding foot 33 depending upon the configuration of the object to be sanded. The alternate sanding foot shapes indicated above are only a few of many possible geometrical shapes.

FIGS. 7 and 8 embodiment configurations are similar to the preferred clamp-on type attachment 11 in FIG.2. The primary differences are the locations of the sanding foot extensions 60, 62 and the arced triangular sanding foot 33 as compared to the clamp-on type attachment 11 in FIG. 1. In FIG. 1, the body of vibratory sander 19 is held in a vertical or upright position. In the FIGS. 7 and 8 embodiments, the body of vibratory sander 19 is held in a relatively horizontal position which allows greater ease in holding and controlling the vibratory sander while edge and corner sanding. This feature is made possible by attaching an L-shaped sanding foot extension 60, 62 to the side or underside of rectangular plates 58. The procedures for installing or removing this embodiment are exactly the same as those described for the preferred clamp-on type attachment 11 shown in FIGS. 1 and 2.

FIGS. 9 and 10 embodiment configurations utilize a method of clamping a sanding attachment diagonally from one corner to the other corner of platen 15. Corner clamp-on attachment 64 is installed on a vibratory sander by utilizing corner clamp adjusting knob 74 to unscrew corner clamp threaded rod 72 sufficiently so that corner tabs 66 can be positioned on the diagonal corners of platen 15. Corner clamp adjusting knob 74 is then utilized to tighten and firmly compress corner tabs 66 against the diagonal corners of platen 15. Arced triangular sanding foot 33 is then installed in the same manner as described for preferred clamp-on type attachment 11, FIG. 2.

Accordingly, the reader will see that the universal edge and corner sanding preferred attachment and embodied attachments of this invention provide a relatively inexpensive and both easily installed and detachable device for edge and corner sanding which is more affordable than the specialized powered edge and corner sanders presently on the market. In addition, its application is universal to all types and shapes of said sanders. The edge and corner sanding attachments adaptable to hand grinders, on the market today, are limited to only certain types of hand grinders and require special tools to connect and also disconnect from the hand grinder. My invention can very quickly be connected and disconnected from said sanders.

Although the description above contains many specifications, these should not be construed as limiting the scope of the invention but as merely providing illustrations of some of the preferred embodiments of this invention. For example, FIG. 4 shows a sandwich plate attachment which can be attached directly to a sander platen 15 shown in FIG. 1 and FIG. 4. FIG. 5 shows a plate type attachment which is attached directly to a sander platen 15 shown at FIG. 1 and FIG. 4. FIG. 6 shows a triangle 55, circular 56 and elliptical 57 shape for the sanding foot. FIGS. 7 and 8 show an embodiment which permits holding the body of vibratory sander 19 FIG. 1 in a horizontal position while edge and corner sanding. In addition, the physical material used to construct my invention could also be a plastic derivative or other material capable of meeting or exceeding the requirements of the preferred parts.

Thus the scope of the invention should be determined not by the embodiment(s) illustrated, but by the appended claims and their legal equivalents.

We claim:

1. An adapter for attachment to an area sander of the type having a motor driven, vibrating platen, said platen having a planar surface with a perimeter and wherein said adapter is configured to convert the area sander into an edge and corner sanding device, said adapter comprising:

a foot having a configuration adapted to sand edges and corners; and means for rigidly and releasably connecting the foot to the platen in a manner such that said foot is spaced from the surface of the platen and located beyond the perimeter thereof so that said foot may be positioned along an edge or corner to be sanded without interference from the platen and with said connecting means including a pair of opposed tabs extending perpendicularly with respect to the surface of the platen and abutting the periphery of the platen and means for selectively drawing the tabs into tight fitting engagement with the platen such that the vibration of the platen is directly transferred to the sanding foot.

2. An adapter as recited in claim 1 wherein said connecting means further includes a pair of rigid plates connected to said tabs and engaging the planar surface of said platen.

3. An adapter as recited in claim 2 wherein said connecting means further includes a pair of rods, with one end of each rod being affixed to one of said plates and with the other end of each rod passing through the other plate and terminating in a threaded portion, said connecting means further including a pair of threaded knobs mounted on the threaded portions of said rods whereby when said knobs are rotated, the plates are drawn together causing said tabs to bear on the periphery of said platen.

4. An adapter as recited in claim 2 wherein said connecting means includes an extension member projecting outwardly and downwardly from one of said plates and supporting said foot.

5. An adapter as recited in claim 2 wherein the periphery of the platen includes corners and wherein said tabs are configured to engage with opposed corners of the platen.

6. An adapter as recited in claim 5 wherein the means for selectively drawing the tabs into tight fitting engagement with the platen includes a threaded rod connected between the pair of plates.

7. An adapter as recited in claim 1 wherein the periphery of the platen includes corners and wherein said tabs are provided with a right-angle configuration and are oriented to engage with the corners of the platen.

8. An adapter as recited in claim 7 wherein said connecting means further includes an adjustable rod member connected to said tabs.

9. An adapter as recited in claim 1 wherein said foot has a planar surface which is oriented in a plane parallel to the plane of the platen.

10. An adapter as recited in claim 1 wherein said foot has a planar surface which is oriented in a plane that is not parallel to the plane of the platen.

11. An adapter as recited in claim 1 wherein said foot has a planar surface which is oriented in a plane perpendicular to the plane of the platen.

* * * * *